US005906070A

United States Patent [19]

Boerhave

[11] Patent Number: 5,906,070

[45] Date of Patent: May 25, 1999

[54] WINDOW PROTECTOR

[76] Inventor: Evert J. Boerhave, 2410 Taylor St. NE., Minneapolis, Minn. 55418

[21] Appl. No.: 08/922,670

[22] Filed: Sep. 3, 1997

[51] Int. Cl.[6] ..... E05D 15/08

[52] U.S. Cl. ..... 49/207; 49/61

[58] Field of Search ..... 49/61, 62, 63, 49/449, 450, 404, 207

[56] References Cited

U.S. PATENT DOCUMENTS

| | | | |
|---|---|---|---|
| 554,305 | 2/1896 | Pool . | |
| 916,803 | 3/1909 | Triggs . | |
| 1,491,497 | 4/1924 | Studer | 49/207 |
| 1,512,067 | 10/1924 | Thomsen . | |
| 2,012,388 | 8/1935 | Goodman . | |
| 2,850,312 | 9/1958 | Rifkin | 49/450 X |
| 2,936,463 | 5/1960 | Tracy . | |
| 3,021,898 | 2/1962 | Crusellas et al. . | |
| 4,121,379 | 10/1978 | Everson | 49/61 |
| 4,158,896 | 6/1979 | Farkas . | |
| 4,199,900 | 4/1980 | Johnston et al. | 49/63 X |
| 4,326,360 | 4/1982 | Davidson . | |
| 4,434,579 | 3/1984 | Murphy | 49/63 |
| 4,682,443 | 7/1987 | Demo . | |
| 4,891,850 | 1/1990 | Borstcher . | |
| 5,603,190 | 2/1997 | Sanford | 49/61 X |

FOREIGN PATENT DOCUMENTS

| | | |
|---|---|---|
| 5156874 | 6/1993 | Japan . |

*Primary Examiner*—Jerry Redman

*Attorney, Agent, or Firm*—Oppenheimer Wolff & Donnelly LLP

[57] ABSTRACT

The present invention is a window protector device suitable for protecting a window and window frame from excess moisture. The present invention has a slidable shield slidably attached between two parallel rails rigidly attached on either side of and along a window. The shield may be slidably moved in front of a window when protection is needed and slidably moved away from the window when not needed. A locking means can be utilized to releasably engage the shield in a desired position.

4 Claims, 4 Drawing Sheets

34
32
36
43
38
45
43
44
25
25
39
16
42
44
42
44
42

34
32
36
38
10
14
16
25

WINDOW PROTECTOR

BACKGROUND OF THE INVENTION

The present invention is a device for use in protecting a window from excess moisture. More specifically, the present invention relates to a slidable shield used to protect a window, located in a shower alcove, by physically preventing water spray from landing on the window or window frame.

Many homes, especially older homes, have windows located in the shower alcove of a bathroom. In a majority of cases, the window is located in the shower alcove because, originally when the house was built, the bathroom only possessed a bathtub and a shower facility was not existent. The placement of the window on an exterior wall adjacent and above the bathtub was not, therefore, likely to result in water contacting the window or window frame causing subsequent damage. In most cases, because of the relative small size of the bathroom, the window in the shower alcove is the only window in the bathroom.

When the window is located in the shower alcove, no matter how careful one might be, the window and window frame are usually sprayed with water when the shower is utilized. To move the window out of the shower alcove, however, is usually not an available option due to cost and/or structural limitations. For example, when the bathtub in the older home is located next to the only exterior wall in the bathroom, the window cannot be moved to another wall. Completely removing the window from the bathroom is normally not an alternative either, because its removal would eliminate the main source of outside ventilation and natural light.

The window and window frame in the shower alcove, because of water spray from the shower head, are highly susceptible to moisture damage such as rot, mold, mildew and rust. In addition, during the winter months, water spray from the shower contacts the window or window frame and is then absorbed into the window frame. This can cause structural damage if the water freezes and expands. Consequently, because removal of the window would leave the bathroom without natural light or good ventilation and because of a general enthusiasm for maintaining a window in the bathroom, a need exists to protect a window from water spray which is effective, low-maintenance, low-cost, and aesthetically pleasing.

One conventional way of protecting a window or window frame from water spray is to install a water-resistant curtain across the window or window frame. This method of protecting the window or window frame, however, is not very effective because the curtain is a loose, hanging apparatus that does not tightly seal around and across the window or window frame. The lack of a tight seal fails to completely prevent all water spray from contacting the window or window frame. In addition, because the curtain must be water-resistant to be effective, its heavy plastic look is not aesthetically pleasing. Cleaning the curtain can be time consuming and/or cumbersome. Because of a curtain's folded configuration, wiping the curtain while hanging can be tedious and time consuming. Similarly, while removing the curtain for cleaning will make the cleaning work easier, the act of removing the curtain from its hanging apparatus can be time consuming, eliminating any time saved actually cleaning the curtain. Furthermore, because the curtain usually does not completely enclose a window or window frame, it does not provide complete privacy in a shower alcove from outside the window.

Another conventional method of protecting a window or window frame from water spray is to completely seal the window frame with a plastic sheet. While this means of protecting a window or window frame from water spray often works effectively in preventing water spray from contacting the window or window frame, it precludes an individual from opening and/or cleaning the window without performing the time-consuming chore of removing the plastic sheet first. Furthermore, if the window is the only source of outside air ventilation in the bathroom and ventilation is needed after every shower, the continual removing of the plastic sheet becomes especially aggravating. Consequently, the inability to ventilate the bathroom will likely result in mold, mildew, rot and/or rust occurring elsewhere in the bathroom as opposed to the window or window frame. The use of a plastic sheet over the window also usually results in decreased visibility through the window and decreased natural light. In addition, the plastic sheet means of protecting a window is not aesthetically pleasing because it is usually attached to the window frame with an adhesive or a tacking device and the plastic sheet requires periodic changing because of soap scum build up or hard water deposit build up.

The conventional methods of protecting a window from water spray, set forth above, are not desirable. As mentioned, using a curtain to protect a window is ineffective because it does not completely seal around a window or window frame resulting in spray from the shower head contacting the window or window frame. In addition, the curtain is difficult to clean and does not always provide an adequate means of privacy. The conventional method of applying a plastic sheet over the window frame, although effective in preventing water spray from contacting the window or window frame, is not effective in allowing adequate window access, adequate ventilation or adequate natural light through the window. In addition, the longevity of the plastic sheet is very limited due to its slight construction.

SUMMARY OF THE INVENTION

The present invention is a window protector device suitable for protecting a window or window frame from excess moisture. The present invention, in one embodiment, is a slidable shield suitable for protecting a window or window frame, located in a shower alcove, from being struck by water spray from a shower head located in the shower alcove. The window protector device includes a shield slidably attached to each of and between two parallel rails. The parallel rails, in operation, are fixedly attached to a wall along the window frame in a shower alcove. The shield, as forementioned, is slidably attached between the two parallel rails. In order to protect the window and window frame in operation, the shield is slid upwards along the interior face of the window until the shield covers the window. When not in operation, the window shield is slid downward along the interior face of the window until the window is exposed a desired amount. At least one locking mechanism, positioned on one or more of the rails, is used to releasably lock the shield in a desired location.

The present invention is an improvement over the conventional method of using a curtain because of its greater sealing, visibility, ventilation and cleaning qualities. The present invention, because the shield spans across the entire face of the window and such shield fits slidably within the two parallel rails, creates a much greater sealed environment around the window frame than the curtain. In addition, the present invention is also an improvement over the conventional method of using a curtain, because the greater seal inherent in the present invention provides for greater privacy than the curtain.

In one embodiment, the present invention provides for better visibility than a curtain because the present invention can be comprised of a transparent plastic material that readily allows natural light to pass through the window and into the shower alcove during operation. The present invention also provides for improved ventilation because, during operation, the shield may be positioned along the parallel rails at a point beyond which water spray will strike the window, but still allow air to pass along the top and bottom of the shield and out or in through the open window. Because of the vertical position of the curtain, however, partially opening the curtain for ventilation during use of the shower exposes the entire length of a section of the window and window frame to water spray, specifically the lower part of the window and/or window frame where the water spray is apt to be directed. On the contrary, because access for ventilation with regard to the present invention can be positioned near the top of the present invention adjacent the top of the window, away from the water spray, the present invention is an improvement with regard to ventilation over the curtain.

The present invention is also an improvement over the conventional method of using a curtain with regard to cleaning. In order to clean the present invention, one simply has to wipe down the face of the shield facing the shower alcove and then simply slide out the shield in order to wipe the interior face of the shield that is adjacent the window. Cleaning of the curtain, however, is much more difficult because the curtain is not a flat, smooth surface that can readily be wiped with a sponge in a few short strokes. In addition, because the curtain is normally attached to a horizontal rod through a series of rings, removing the curtain for cleaning is far more difficult than the simple unlocking of the locking mechanism to remove the shield on the present invention.

The present invention is an improvement over the conventional apparatus and method of using a plastic sheet to protect the window or window frame because the plastic sheet does not provide a means of ventilation during or after use of the shower. The use of a plastic sheet over a window precludes access to the window when the sheet is in place. To gain access to the window, one must remove the plastic sheet from the window. Normally this requires one to either peel off an adhesive or remove some sort of tacking device. With the plastic sheet, one cannot utilize the shower and ventilate the shower at the same time because water spray will strike the window and window frame. Ventilation defeats the purpose of the plastic sheet. In addition, because the plastic sheet must be removed after use of the shower to allow for ventilation, the present invention is a much greater improvement over the plastic sheet because the present invention may simply be slid away from the window when not in use. Similarly, to replace the plastic sheet, an individual must physically reattach the sheet to the window frame with either an adhesive or other tacking device, while with the present invention an individual only has to slide the shield back across the window.

The present invention is also an improvement over the conventional plastic sheet because of the longevity and ease of cleaning of the present invention. Because of the plastic sheet's thin structure, the plastic sheet is not as durable as the present invention and, therefore, will not have the same longevity as the present invention. In addition, the present invention is far easier to clean than the conventional plastic sheet. In order to clean the plastic sheet, one must wipe the sheet on the side facing the shower alcove, then remove the adhesive and/or tacking devices in order to wash the other side of the plastic sheet. Upon completion of the washing of the plastic sheet, the plastic sheet must be reattached with the adhesive and/or tacking device. This is very time consuming. The present invention, however, as set forth above, can readily be cleaned with the simple action of wiping the exterior face of the shield facing the shower alcove with a sponge and then wiping the interior face of the shield with a sponge after the shield is readily removed from between the two rails by disengaging the locking mechanism. After cleaning, the shield is easily placed back between the two rails by simply sliding the shield between the rails and reengaging the locking mechanism.

While the present invention has been described as a shield, slidably attached between two rails with a locking means fixedly attached to a rail for releasably engaging the shield, other variations and modifications may be made to the invention described herein without deviating from the scope and spirit of the invention. For example, in one embodiment, the parallel rails are positioned in a horizontal array with the shield horizontally slidably attached therebetween.

Numerous variations and modifications may be made to the shield without deviating from the scope and spirit of the invention. For example, the shield can include a window disposed therein allowing natural light to pass through the shield into the shower alcove while the present invention is in operation or the shield can comprise a transparent plastic material that allows light to pass through all of the shield. In yet another embodiment of the present invention, the present invention includes a mechanical means for driving the shield along and between the parallel rails a specified distance.

BRIEF DESCRIPTION OF THE DRAWINGS

The above-mentioned objects and advantages can be more clearly seen by referring to the following detailed description and the drawings in which.

DETAILED DESCRIPTION OF THE INVENTION

Figure 1:
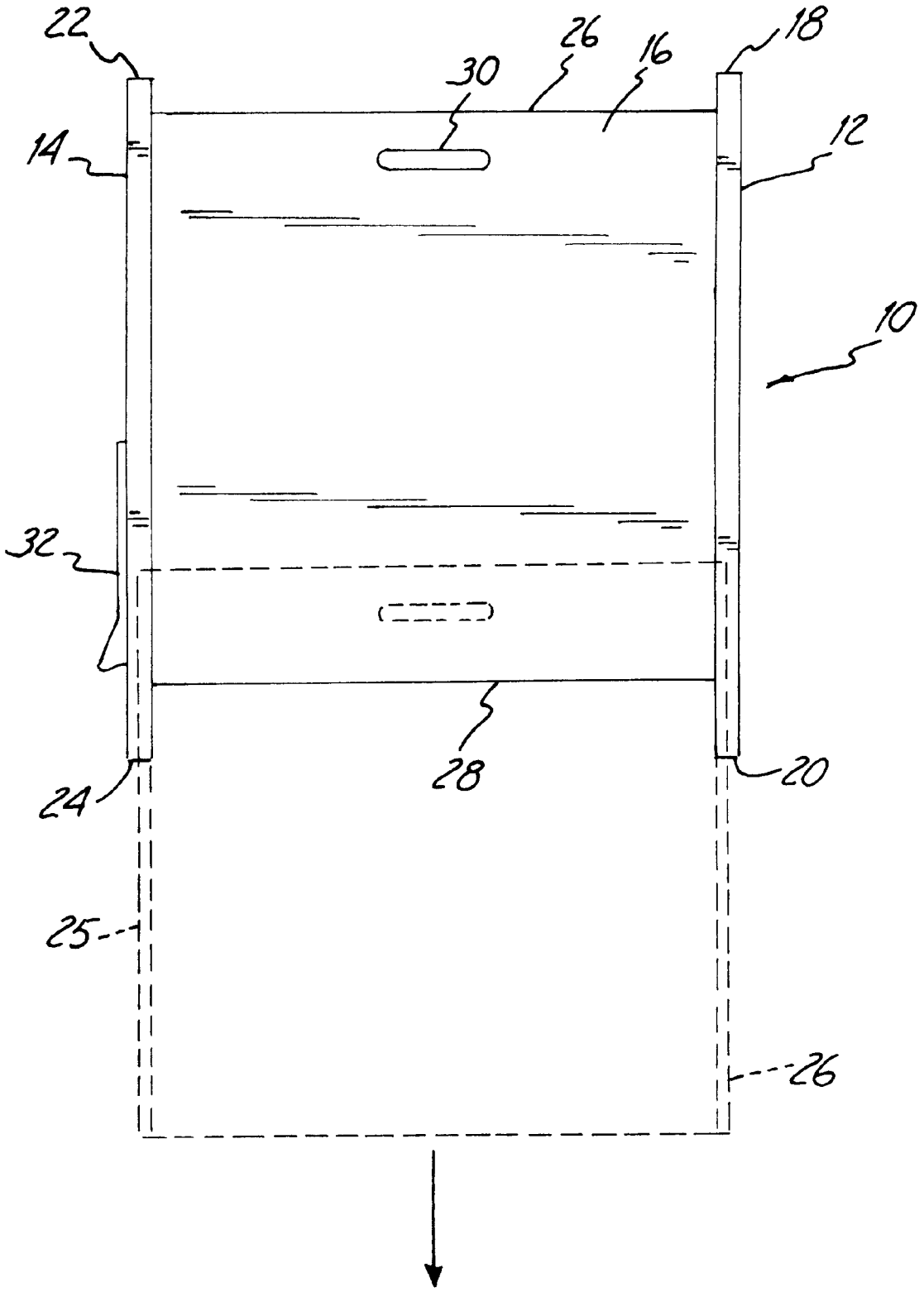
FIG. 1 is a front view of the window protector depicting vertical movement of the shield.

Referring now to FIG. 1 which shows a front view of the present invention. For convenience, like numbers have been used to identify like parts.

FIG. 1 depicts a first embodiment of the present invention shown generally throughout as a window protector 10 comprising a right rail 12, a left rail 14 and a shield 16. Right rail 12 includes a right rail top 18 and a right rail bottom 20. Left rail 14 includes a left rail top 22 and a left rail bottom 24. Left rail 12 and right rail 14 are positioned parallel to each other. Shield 16 includes a left shield guide 25, a right shield guide 26, a shield top 27, a shield bottom 28 and a shield handle 30. Shield 16 is slidably attached between right rail 12 and left rail 14. Fixedly attached to left rail 14 toward left rail bottom 24 is a locking latch 32 for releasably engaging shield 16.

Figure 2:
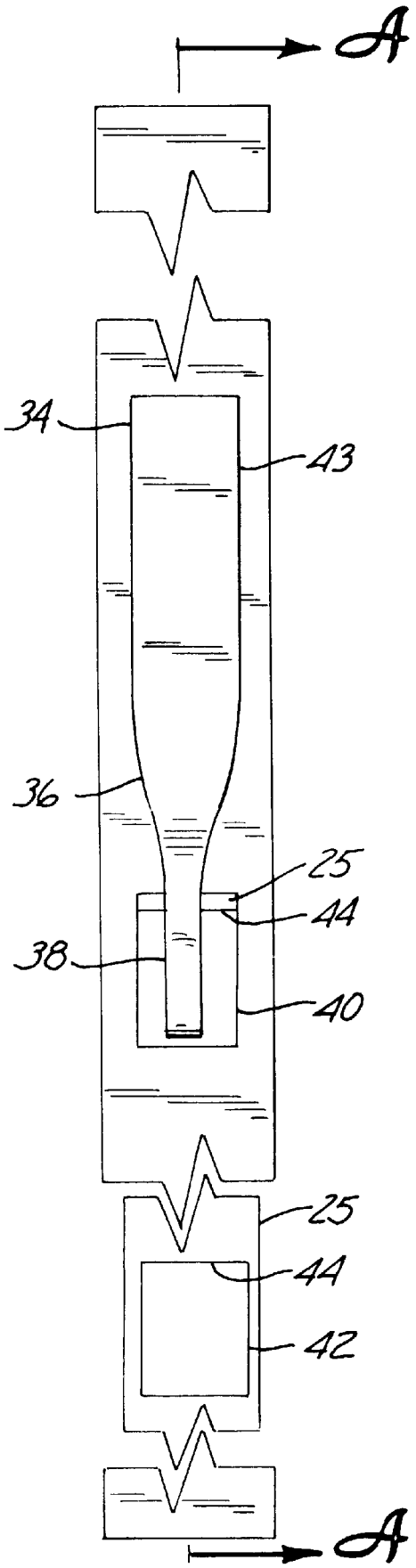
FIG. 2 is a partial side view of the present invention.

Referring to FIG. 2 there is shown locking latch 32 positioned on left rail 14. Locking latch 32 includes a rail attachment end 34, a spring section 36 and a locking head 38. Slidably positioned within left rail 14 is left shield guide 25 attached to shield 16. Extending through left rail 14 is a latch opening 40. Extending through left shield guide 25 is a plurality of locking cutouts 42, each locking cutout 42 having a locking edge 44 for releasably engaging locking head 38. The plurality of locking cutouts are positioned along left shield guide 25 to provide predetermined positioning of shield 16. Slidable movement of shield 16 is accomplished by springingly bending back locking latch 32 along spring section 36 allowing locking cutout 42 to pass by, without obstruction, locking head 38.

Figure 4:
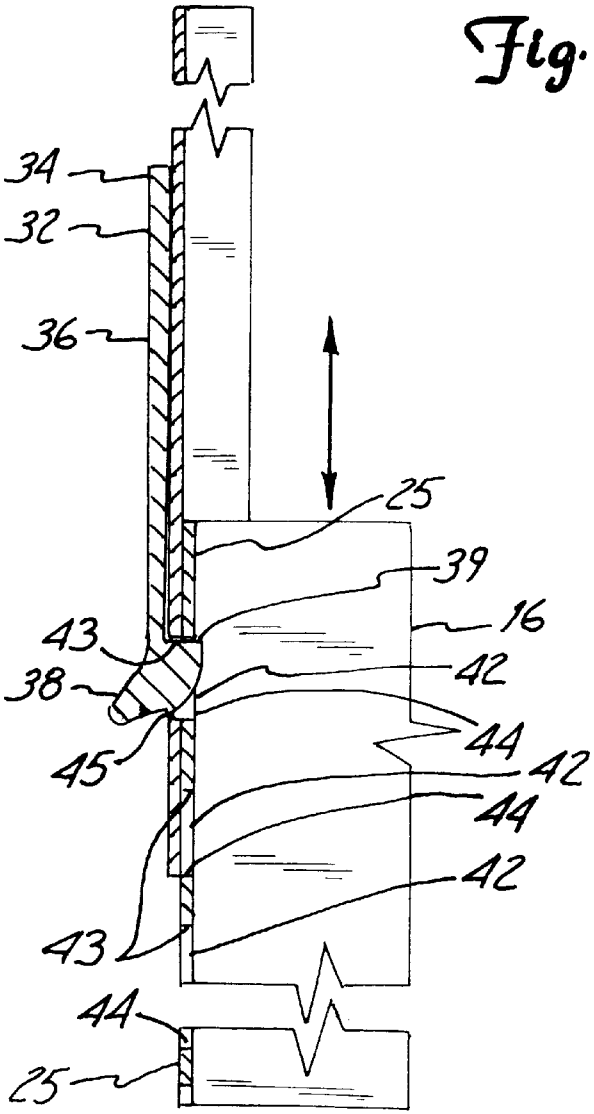
FIG. 4 is a partial front view, with partial cross section, of the present invention showing the locking mechanism releasably engaging the shield.
Figure 3:
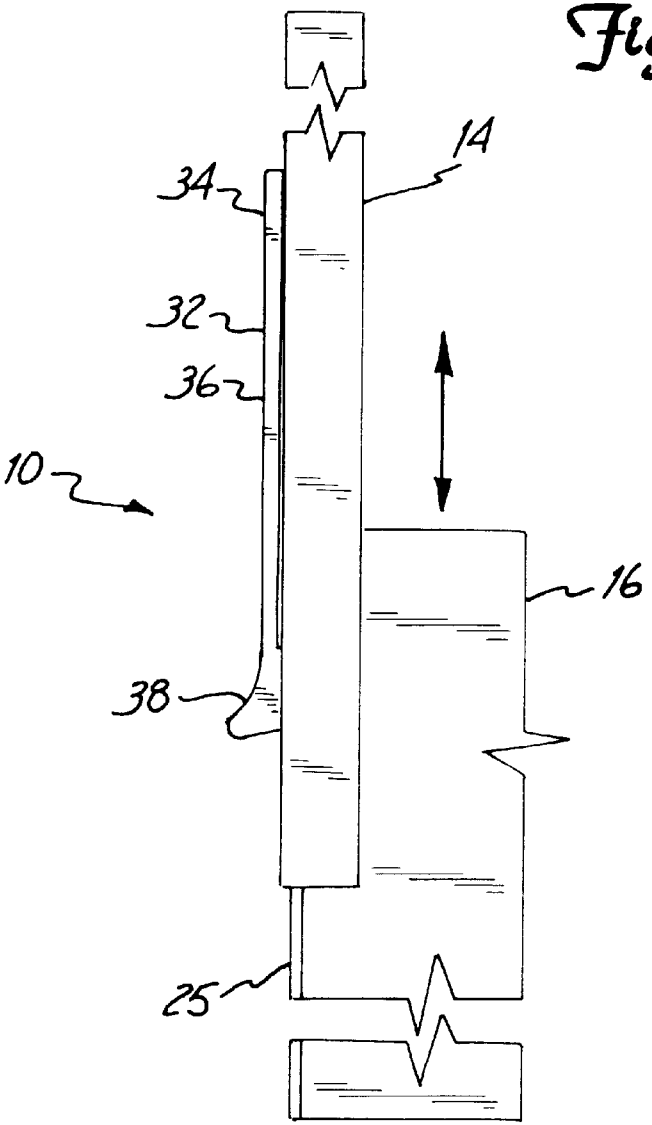
FIG. 3 is a partial front view of the present invention.

FIGS. 3 and 4 depict a side view of locking latch 32. More specifically, FIG. 3 depicts a front, partial view of window protector 10 and a detailed view of locking latch 32, locking latch 32 including rail attachment end 34, spring section 36 and locking head 38. FIG. 4 depicts a front, partial sectional view of window protector 10 and locking latch 32. In operation, shield 16 is secured in place by a locking lip 39 projecting outward from locking head 38, locking lip 39 releasably engaging locking cutout 42 at a locking edge 43 disposed within locking cutout 42. Opposite locking edge 43, disposed within locking cutout 42, is an opening edge 44. When shield 16 is moved toward right rail top 18 and left rail top 22, opening edge 44 strikes against a leading edge 45 formed at the end of locking head 38 opposite locking lip 39. Leading edge 45 has an angled configuration such that when opening edge 44 strikes leading edge 45, opening edge 44 springingly forces back locking head 38 in cam-like fashion allowing locking cutout 42 to pass along locking head 38.

Figure 5:
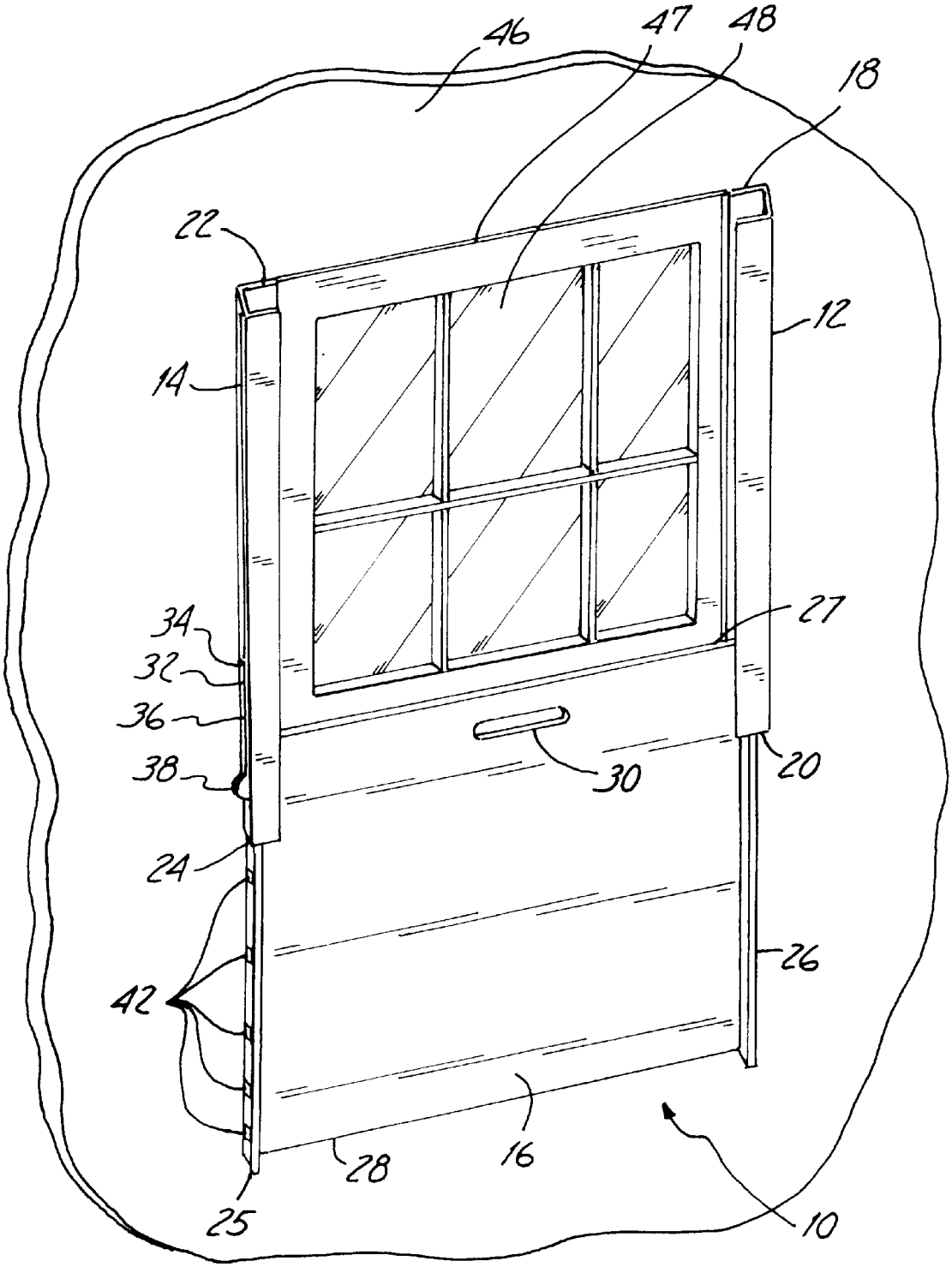
FIG. 5 is a front elevational view of the present invention as shown attached to a wall adjacent window with the shield in an open position.

FIG. 5 depicts a front elevational view of the present invention wherein window protector 10 is in an open position. FIG. 5 further depicts window protector 10 rigidly attached to a wall 46 adjacent a window frame 47 enclosing a window 48. In operation, to position window protector 10 in the open position, shield 16, including left shield guide 25 and right shield guide 26, must be moved downward toward right rail bottom 20 and left rail bottom 24 until locking edge 43 on locking cutout 42 adjacent shield top 27 releasably engages locking lip 39 on locking head 38.

Having illustrated and described the principles of the present invention in the preferred embodiment it will be apparent to those skilled in the art that the invention can be modified in arrangement and detail without departing from such principles. I claim all modifications coming within the scope and spirit of the following claims.

It is claimed:

1. The window protector device for protecting a window, the window protector comprising:

a left and a right rail of predetermined length, the left rail parallel to the right rail, the left rail having a top end and a bottom end, the right rail having a top end and a bottom end;

a rectangular shield having a handle, a left shield side, a right shield side, a shield top and a shield bottom, the rectangular shield positioned between the left and the right rail such that the top ends of the left rail and right rail are adjacent the shield top when the shield is slid completely toward the top ends of the left and right rails, the bottom ends of the left and right rail adjacent the shield bottom when the shield is slid toward the top ends of the left and right rails;

a left guide, the left guide fixedly attached perpendicular to the left shield side, the left guide having a top end adjacent the shield top and a bottom end adjacent the shield bottom, the left guide slidably engaging the left rail;

a right guide, the right guide fixedly attached perpendicular to the right shield side, the right guide having a top end adjacent the shield top and a bottom end adjacent the shield bottom, the right guide slidably engaging the right rail;

a plurality of cutouts, the cutouts positioned along and extending through the left guide, at least one cutout positioned adjacent the top end of the left guide and at least one cutout positioned adjacent the bottom end of the left guide;

a locking latch, the locking latch having a first end and a second end, the locking latch further having a rail attachment end, a spring section and a locking head, the rail attachment end disposed on the first end, rigidly attached to a side of the left rail toward the bottom end of the left rail, the spring section extending along the left rail between the rail attachment end and the locking head, the locking head disposed on the second end, the locking head for releasably engaging a cutout; and a latch opening extending through the left rail, the latch opening positioned to align with a cutout when the cutout is positioned adjacent the latch opening, the latch opening positioned to receive the locking head for engaging a cutout positioned adjacent the latch opening.

2. The window protector device claimed in claim 1, wherein the shield has a domed surface.

3. The window protector device claimed in claim 1, wherein the shield comprises transparent material.

4. The window protector device claimed in claim 1, wherein each of the left rail and the right rail have means for rigidly attaching to a flat surface.

* * * * *